US012402674B2

(12) United States Patent
Genender et al.

(10) Patent No.: US 12,402,674 B2
(45) Date of Patent: Sep. 2, 2025

(54) GOWN WITH CONCENTRIC SLEEVES AND CORRESPONDING METHODS

(71) Applicant: Medline Industries, LP, Mundelein, IL (US)

(72) Inventors: Alan Genender, Northbrook, IL (US); Audrey Putnam, Chicago, IL (US)

(73) Assignee: Medline Industries LP, Northfield, IL (US)

( * ) Notice: Subject to any disclaimer, the term of this patent is extended or adjusted under 35 U.S.C. 154(b) by 1169 days.

(21) Appl. No.: 15/285,145

(22) Filed: Oct. 4, 2016

(65) Prior Publication Data

US 2018/0092412 A1 Apr. 5, 2018

(51) Int. Cl.
*A41D 13/12* (2006.01)
*A41D 27/10* (2006.01)

(52) U.S. Cl.
CPC ..... *A41D 13/1227* (2013.01); *A41D 27/10* (2013.01); *A41D 13/1209* (2013.01)

(58) Field of Classification Search
CPC ..... A41D 13/1227; A41D 13/1209
See application file for complete search history.

(56) References Cited

U.S. PATENT DOCUMENTS 2,668,294 A * 2/1954 Gilpin ..... A41D 13/1209 2/114
3,868,728 A * 3/1975 Krzewinski ..... A41D 13/1227 2/114
D279,040 S 6/1985 Horox
4,535,481 A * 8/1985 Ruth-Larson ..... A41D 13/1209 2/114
4,937,883 A * 7/1990 Shirai ..... A41D 1/04 2/113
D325,459 S 4/1992 Keever
5,142,704 A * 9/1992 Viemeister ..... A41D 13/1218 2/171
D351,712 S 10/1994 Jackson
5,444,871 A * 8/1995 Lopez ..... A41D 13/1227 2/114
D374,113 S 10/1996 Console
6,115,839 A 9/2000 Covington et al.
D469,945 S 2/2003 Mayer
D622,934 S 9/2010 Graneto, III
(Continued)

OTHER PUBLICATIONS

"Polyethylene Thumb Loop Style Isolation Gowns", Medline Catalog; Unkown Publication date but believed to be prior to filing of present application; https://www.medline.com/catalog/catalog.jsp.
(Continued)

*Primary Examiner* — Alissa J Tompkins
(74) *Attorney, Agent, or Firm* — Philip H. Burrus, IV

(57) ABSTRACT

A gown (100) includes a body covering portion (101). A first sleeve (107) and a second sleeve (108) each extend distally away from the body covering portion and terminating at a retention device (109,110). A first concentric sleeve (119) is coupled to the first sleeve at a first connection location (121) and extends along an exterior of the first sleeve toward the retention device. A second concentric sleeve (120) is coupled to the second sleeve at a second connection location (122) and extends along the exterior of the second sleeve toward the retention device.

17 Claims, 12 Drawing Sheets

(56) References Cited

U.S. PATENT DOCUMENTS

| | | | | |
|---|---|---|---|---|
| D624,280 | S | 9/2010 | Halseth | |
| D646,463 | S | 10/2011 | Petrovskis et al. | |
| D681,915 | S | 5/2013 | Walrich et al. | |
| D687,209 | S | 8/2013 | Levine | |
| D721,870 | S | 2/2015 | Levine | |
| D736,493 | S | 8/2015 | Pasko | |
| D741,044 | S | 10/2015 | Pasko | |
| D749,819 | S | 2/2016 | Czajka et al. | |
| D764,748 | S | 8/2016 | Czajka et al. | |
| 2006/0041988 | A1* | 3/2006 | Bushman | A41D 13/1227 2/59 |
| 2011/0239349 | A1* | 10/2011 | Thompson | A41D 13/1209 2/48 |
| 2013/0036526 | A1 | 2/2013 | Rashman | |
| 2013/0191960 | A1 | 8/2013 | Pasko | |
| 2013/0305426 | A1* | 11/2013 | Walrich | A41D 27/10 2/243.1 |
| 2014/0007316 | A1 | 1/2014 | Tommarello et al. | |
| 2015/0135397 | A1 | 5/2015 | Levine | |
| 2016/0000150 | A1* | 1/2016 | Gucciardi | A41D 13/0015 2/69 |

OTHER PUBLICATIONS

Moore Jr, Clese , "Notice of Allowance", U.S. Appl. No. 29/579,902, filed Oct. 4, 2016; Mailed Jan. 31, 2018.

Moore Jr., Clese , "Notice of Allowance", U.S. Appl. No. 29/586,255, filed Dec. 1, 2016; Mailed Jan. 12, 2018.

Moore Jr, Clese , "Restriction Requirement", U.S. Appl. No. 29/586,255, filed Dec. 1, 2016; Mailed Sep. 29, 2017.

Moore Jr., Clese , "Restriction Requirement", U.S. Appl. No. 29/579,902, filed Oct. 4, 2016; Mailed Sep. 29, 2017.

* cited by examiner

GOWN WITH CONCENTRIC SLEEVES AND CORRESPONDING METHODS

BACKGROUND

Technical Field

This disclosure relates generally to gowns, and more particularly to gowns with sleeves.

Background Art

Medical professionals frequently interact with various fluids, waste matter, and pathogens when rendering medical services. For example, when working in a decontamination area with medical instruments such as endoscopes, medical personnel may be exposed to high volumes of fluid. It is important to keep such fluids away from the skin, as such contact can result in the medical professional becoming infected or ill due to the microorganisms or pathogens present in the fluids.

One common technique to try and prevent fluids from contacting the skin is by donning a gown. However, prior art gowns can actually increase the chance of fluids contacting the skin by way of their construction. Some gowns can bend and fold in ways that actually "channel" fluid down the arms of a gown to a glove, thereby increasing the risk that the medical professional's hands will contact the fluid. Such pathways put the medical services provider at risk of becoming ill. It would be advantageous to have a gown that overcomes some of the issues associated with prior art medical gowns.

Figure 1:
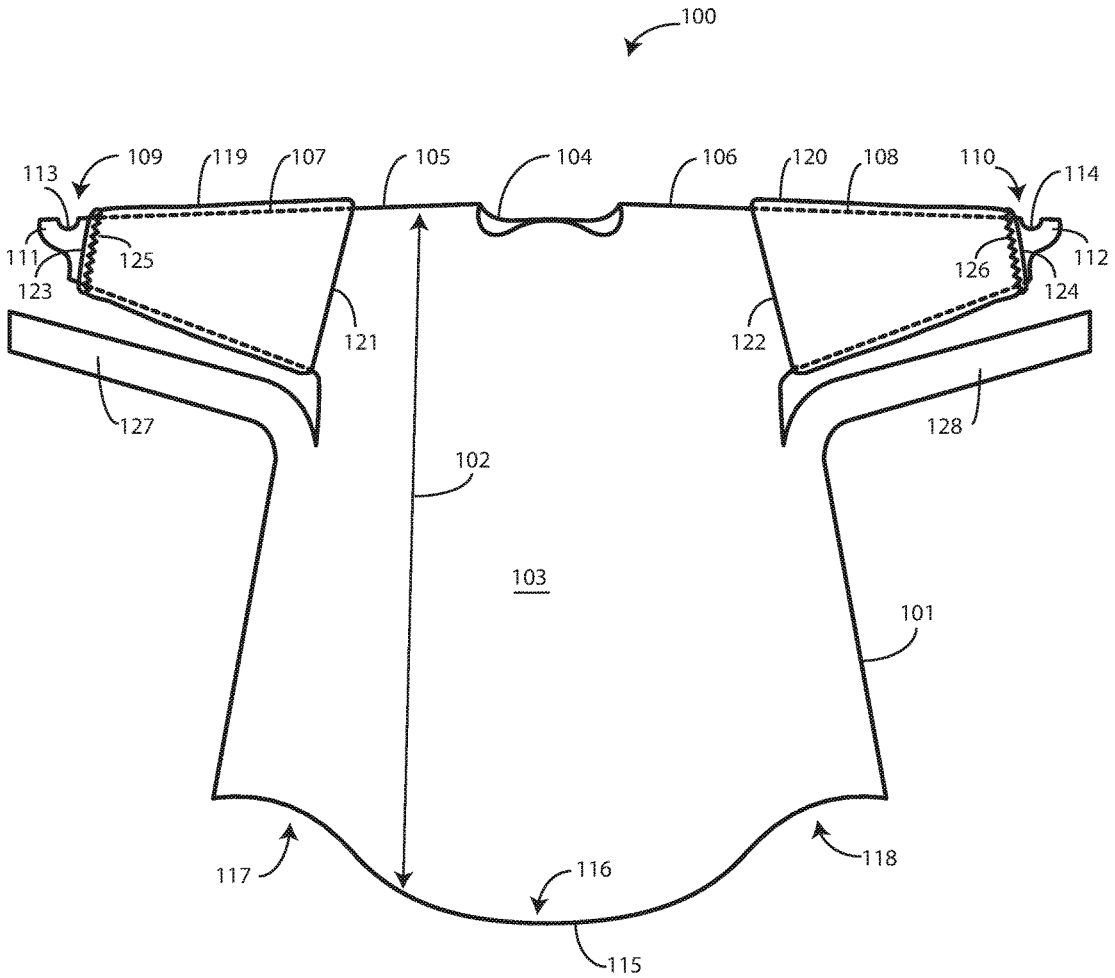
FIG. 1 illustrates a front elevation view of one explanatory gown in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a gown having dual sleeves, i.e., a first sleeve with a second, concentric sleeve coupled to and disposed about the exterior of the first sleeve. In one embodiment, the first sleeve has a retention device, such as a thumb loop or knitted cuff, that retains the first sleeve to the arm of a wearer. A second, outer concentric sleeve is attached to the first sleeve at a connection location. The outer concentric sleeve extends along the exterior of the first sleeve toward the retention device and terminates at a termination boundary, which defines the end of the outer concentric sleeve. In one or more embodiments, the outer concentric sleeve does not extend all the way to the end of the first sleeve. Instead, when extended the first termination boundary is disposed between the retention device and the first connection location.

When donning the gown, a user places their arm into the first sleeve and secures the first sleeve along their arm with the retention device. For example, if the retention device is a thumb loop, the user places their thumb into the thumb loop to keep the first sleeve from sliding up their arm when donning gloves or other objects. Where the retention device is a knitted cuff, the knitted cuff frictionally retains the first sleeve to the arm. Other types of retention devices will be obvious to those of ordinary skill in the art having the benefit of this disclosure.

The user then translates the outer concentric sleeve up their arms toward their elbow, thereby exposing more of the first sleeve. A user can then don gloves. In one or more embodiments, the gloves pass about the exterior of at least a portion of the first sleeve. Once the gloves are donned, the user can then slide the outer concentric sleeve about an exterior of a portion of the glove to define an outer envelope that covers the opening of the glove. In one or more embodiments, the outer concentric sleeve includes an elastic gathering that draws the outer concentric sleeve toward the arm of the user. Accordingly, the first sleeve is covered by a portion of the glove and the outer concentric sleeve is disposed over the glove to prevent the channeling of fluids that is so problematic in prior art designs. Where extra fluid barriers are required, a second glove can be donned atop the first, as well as atop the outer concentric sleeve, to provide additional protection.

Figure 2:
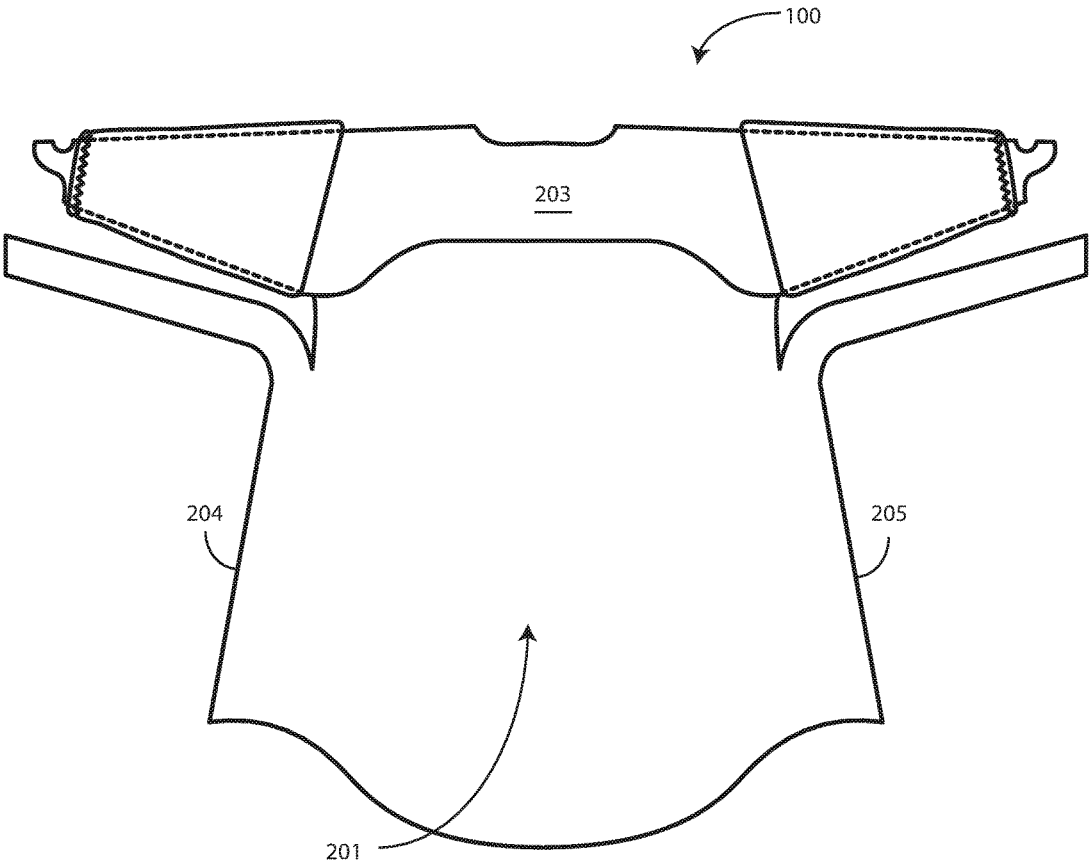
FIG. 2 illustrates a rear elevation view of one explanatory gown in accordance with one or more embodiments of the disclosure.

Turning now to FIGS. 1 and 2, illustrated therein is one example of a gown 100 configured in accordance with one or more embodiments of the invention. A body covering portion 101 is configured to wrap about the torso of a wearer. In one embodiment, the body covering portion 101 is impermeable to fluids. For example, in one embodiment the body covering portion 101 is manufactured from polyethylene. In another embodiment, the body covering portion 101 is manufactured from polypropylene. In yet another embodiment, the body covering portion 101 is manufactured from a non-woven fabric that is coated with polyethylene, polypropylene, or another fluid resistant coating. In still another embodiment, the body covering portion 101 is manufactured from Tyvek.sup.™ Other fluid impermeable materials suitable for use as the body covering portion 101 will be obvious to those of ordinary skill in the art having the benefit of this disclosure. For example, a woven material that includes a water resistant lining that prevents the passage of fluids through the body covering portion 101 can also be used. One or more antimicrobial layers can be added to the body covering portion 101 to further enhance antimicrobial protection.

In still other embodiments, the gown 100 can be configured as a reusable gown. For example, the material from which the gown 100 is manufactured could be washable and/or capable of being sterilized so that the gown can be reused. Illustrating by example, in one embodiment, the gown 100 is manufactured from a washable fabric, such as cotton, polyester, or a cotton polyester blend. In another embodiment, the gown 100 is manufactured from non-woven fabric so as to be disposable.

The length 102 of the body covering portion 101 can vary. In one embodiment, the length 102 of the body covering portion is configured to run from a wearer's shoulder to below their knee. In other embodiments, the length 102 of the body covering portion 101 is configured to run from the wearer's shoulder to a location along their mid-calf. In yet another embodiment, the length 102 of the body covering portion 101 extends from a wearer's shoulder to their feet. Other lengths will be obvious to those of ordinary skill in the art having the benefit of this disclosure.

In one embodiment, the gown 100 may optionally include pockets or other surface features. In other embodiments, these features will be omitted to prevent pooling of liquids. The gown 100 may be manufactured in various colors. However, in one or more embodiments, the gown 100 is blue. However, in other embodiments the gown 100 is yellow. Other colors will be obvious to those of ordinary skill in the art having the benefit of this disclosure.

The body covering portion 101 includes a front portion 103 and a rear portion 203. The front portion 103 is configured as a frontal body covering portion in that it is configured to cover the frontal portion of some or all of a user's body, or in another embodiment the frontal portion of some or all of a user's torso, when the user is wearing the gown. The body covering portion 101 further includes a rear portion 203 that is configured to cover at least a portion of a wearer's backside. In the illustrative example of FIGS. 1 and 2, the front portion 103 is longer than the rear portion 203, thereby covering more of the wearer's body in the front than the rear. However, as will be described below with reference to FIGS. 11-12, the rear portion 203 can have a substantially similar length with the front portion 103. In another embodiment, the front portion 103 will be shorter than the rear portion 203, thereby covering less of the wearer's body in the front than in the rear. This will vary based upon application.

In one embodiment, the body covering portion 101 defines a head insertion aperture 104 through which a user may insert their head when donning the gown. In the illustrative embodiment of FIGS. 1 and 2, the head insertion aperture 104 is disposed between the front portion 103 and the rear portion 203, and is surrounded by shoulder portions 105,106 of the body covering portion 101. The perimeter of the head insertion aperture 104 can take a variety of shapes. For example, in the illustrative embodiment of FIGS. 1 and 2, the head insertion aperture 104 has an inverted curved contour. Other embodiments described below may include different heat insertion aperture contours.

In one embodiment, the body covering portion 101 defines an opening 201. The front portion 103 of the gown 100 is configured, in one embodiment, to be placed against the front of the torso of a wearer. The body covering portion 101 then wraps around and terminates at the opening 201. The opening 201 in this embodiment has a left side 204 and a right side 205, each of which extends upward to the rear portion 203, which sits atop a wearer's shoulders.

The opening can be used to assist in donning the gown. For instance, a user may open the opening 201 and pass their head, shoulders, and/or torso portions through the opening 201 when donning the gown. Said differently, the right side 205 and left side 204 of the opening 201 can be configured to permit the wearer to don the gown 100 by wrapping the right side 205 and left side 204 about the wearer's torso.

The bottom of the gown 100 can take a variety of shapes. For example, in the illustrative embodiment of FIGS. 1 and 2, the front base member 115 of the gown 100 is curved. Other embodiments described below may include different front contours. In this illustrative embodiment, the base member 115 takes a concave down contour, with an arched contour 116 spanning between two convex lobes 117,118.

In one embodiment, a first sleeve 107 and a second sleeve 108 extend distally from the body covering portion 101. The first sleeve 107 and the second sleeve 108 are configured to receive wearer's arms when the medical down 100 is donned. In one embodiment, each of the first sleeve 107 and the second sleeve 108 are configured as single, unitary pieces of liquid impervious material such as polyethylene or polypropylene. The first sleeve 107 and the second sleeve 108 can be contiguous with the body covering portion 101 in one embodiment. Alternatively, they can be attached to the body covering portion at seams (not shown). The seams can be sewn, although other attachment processes can be used as well. Examples of alternative attachment processes include adhesive bonding, mechanical or press-fit bonding, thermal bonding, sonic welding, taping, and so forth. In the illustrated embodiment of FIGS. 1 and 2, the first sleeve 107 and second sleeve 108 are illustrated as long sleeves that cover substantially the entirety of a wearer's arms.

In one or more embodiments, the sleeves 107,108 each terminate at a retention device 109,110 configured to retain the first sleeve 107 and the second sleeve 108 to the arms of a wearer. In this illustrative embodiment, each retention device 109,110 comprises a thumb loop 111,112. However, the retention devices 109,110 can take other forms as well.

Illustrating by example, as will be described below with reference to FIG. 12 below, in other embodiments the retention devices 109,110 can comprise knitted cuffs. In still other embodiments, the retention devices 109,110 can comprise drawstrings. In yet additional embodiments, the retention devices 109,110 can comprise elastic gatherings. Other retention devices 109,110 will be obvious to those of ordinary skill in the art having the benefit of this disclosure.

In this illustrative embodiment, each retention device 109,110 comprises a thumb loop 111,112. In one embodiment, the thumb loop comprises a thumb insertion aperture 113,114, through which a wearer's thumb may be inserted to retain the first sleeve 107 and the second sleeve 108 along the wearer's arm.

The thumb loops 111,112, where included, provide several functions. One illustrative function is that they keep the sleeves 107,108 pulled along the wearer's arms and prevent the sleeves 107,108 from "riding up." Another illustrative function is that the thumb loops 111,112 prevent twisting of the sleeves 107,108 about the wearer's arm. Each thumb loop 111,112 is configured, in one embodiment, to engage the saddle of a thumb of the wearer.

In one or more embodiments, a first concentric sleeve 119 and a second concentric sleeve 120 are coupled to the first sleeve 107 and the second sleeve 108, respectively. In this illustrative embodiment, the first concentric sleeve 119 is coupled to the first sleeve 107 at a first connection location 121, while the second concentric sleeve 120 is coupled to the second sleeve 108 at a second connection location 122. The first connection location 121 and the second connection location 122, in one embodiment, are disposed above the elbow of the first sleeve 107 and the second sleeve 108, respectively. In another embodiment, the first connection location 121 and the second connection location 122 are disposed at the shoulder of the first sleeve 107 and the second sleeve 108, respectively. In other embodiments, the first connection location 121 and the second connection location 122 can be disposed at any location between the wrist area and the shoulder. Other locations for the first connection location 121 and the second connection location 122 will be obvious to those of ordinary skill in the art having the benefit of this disclosure.

In one embodiment, the first concentric sleeve 119 and the second concentric sleeve 120 are coupled to the first sleeve 107 and the second sleeve 108 by thermal bonding. However, other coupling techniques can be used as well. Illustrating by example, in another embodiment the first concentric sleeve 119 and the second concentric sleeve 120 are coupled to the first sleeve 107 and the second sleeve 108 by adhesive bonding. In other embodiments, the first concentric sleeve 119 and the second concentric sleeve 120 are coupled to the first sleeve 107 and the second sleeve 108 by tape. Sonic welding, mechanical bonding, press-fit bonding, or other techniques can be used as well.

In one embodiment, the first concentric sleeve 119 and the second concentric sleeve 120 are manufactured from the same material as the first sleeve 107 and the second sleeve 108. For instance, if the gown 100 and the first sleeve 107 and second sleeve 108 are manufactured from polyethylene, in one embodiment the first concentric sleeve 119 and the second concentric sleeve 120 are manufactured polyethylene as well. In another embodiment, the first concentric sleeve 119 and the second concentric sleeve 120 are manufactured from a different material than that from which the first sleeve 107 and the second sleeve 108 are manufactured. For example, in one embodiment where the first sleeve 107 and the second sleeve 108 are manufactured from polypropylene, the first concentric sleeve 119 and the second concentric sleeve 120 may be manufactured from polyethylene, and so forth.

In this illustrative embodiment, the first concentric sleeve 119 and the second concentric sleeve 120 extend along an exterior of the first sleeve 107 and second sleeve 108, respectively, toward the retention devices 109,110, which in this embodiment are thumb loops 111,112. The first concentric sleeve 119 and the second concentric sleeve 120 extend along an exterior of the first sleeve 107 and second sleeve 108 to a first termination boundary 123 and a second termination boundary 124, respectively.

In this illustrative embodiment the first concentric sleeve 119 and the second concentric sleeve 120 do not extend along the exterior of the first sleeve 107 and second sleeve 108 all the way to the ends of the latter. To the contrary, in this illustrative embodiment the first concentric sleeve 119 and the second concentric sleeve 120 are configured to extend along an exterior of the first sleeve 107 and second sleeve 108 to the first termination boundary 123 and the second termination boundary 124, each of which is designed to land approximately the wrist location of a wearer. Accordingly, in this illustrative embodiment the first termination boundary 123 and the second termination boundary 124 are disposed between the first connection location 121 and the first thumb loop 111, and between the second connection location 122 and the second thumb loop 112, respectively. This results in the first sleeve 107 and the second sleeve 108 extending beyond the first termination boundary 123 and the second termination boundary 124 in this illustrative embodiment.

In one or more embodiments, the first concentric sleeve 119 comprises a first elastic gathering 125. Similarly, the second concentric sleeve 120 comprises a second elastic gathering 126. Each elastic gathering 125,126 is configured to draw the respective concentric sleeve toward the respective sleeve. For example, the first elastic gathering 125 is configured to draw the first concentric sleeve 119 toward the first sleeve 107 in this embodiment. Similarly, the second elastic gathering 126 is configured to draw the second concentric sleeve 120 toward the second sleeve 108.

In this illustrative embodiment, each elastic gathering 125,126 is disposed between its respective connection location and termination boundary. For example, the first elastic gathering 125 is disposed along the first concentric sleeve 119 at a location that is between the first connection location 121 and the first termination boundary 123. Similarly, the second elastic gathering 126 is disposed along the second concentric sleeve 120 at a location that is between the second connection location 122 and the second termination boundary 124. However, embodiments of the disclosure are not so limited. In other embodiments, such as the one described below with reference to FIG. 12, the elastic gatherings 125,126 can be disposed at the first termination boundary 123 and second termination boundary 124, respectively.

In this illustrative embodiment, the first elastic gathering 125 and the second elastic gathering 126 are disposed closer to their respective termination boundaries than to the connection locations at which the concentric sleeves to which the elastic gatherings are attached couples to the sleeves of the gown 100. For example, the first elastic gathering 125 is disposed closer to the first termination boundary 123 than to the first connection location 121. Similarly, the second elastic gathering 126 is disposed closer to the second termination boundary 124 than the second connection location 122 in this embodiment. It should be noted that the elastic gatherings 125,126 can be replaced by other gathering devices, including drawstrings, rubber bands, or other devices. In still other embodiments, the elastic gatherings 125,126 can be omitted.

In one or more embodiments, the first concentric sleeve 119 and the second concentric sleeve 120 are selectively slidable along the first sleeve 107 and the second sleeve 108, respectively, toward and away from the first connection location 121 and the second connection location 122, respectively. For example, in this embodiment the first termination boundary 123 is selectively slidable along the first sleeve 107 toward the first connection location 121. Similarly, the second termination boundary 124 is selectively slidable along the second sleeve 108 toward the second connection location 122.

In one or more embodiments, the gown 100 can include one or more tie members 127,128 extending from the body covering portion 101. In this illustrative embodiment, the tie members include a first tie member 127 extending from the left side 204 and a second tie member 128 extending from the right side 205 of the gown. Accordingly, one tie member 127 is disposed on one side of the opening 201, while the second tie member 128 is disposed on a second side of the opening. Here, the tie members 127,128 are contiguous with the body covering portion 101. However, they can be attached to the body covering portion 101 as well. Such embodiments are described below with reference to FIGS. 9-12.

Figure 3:
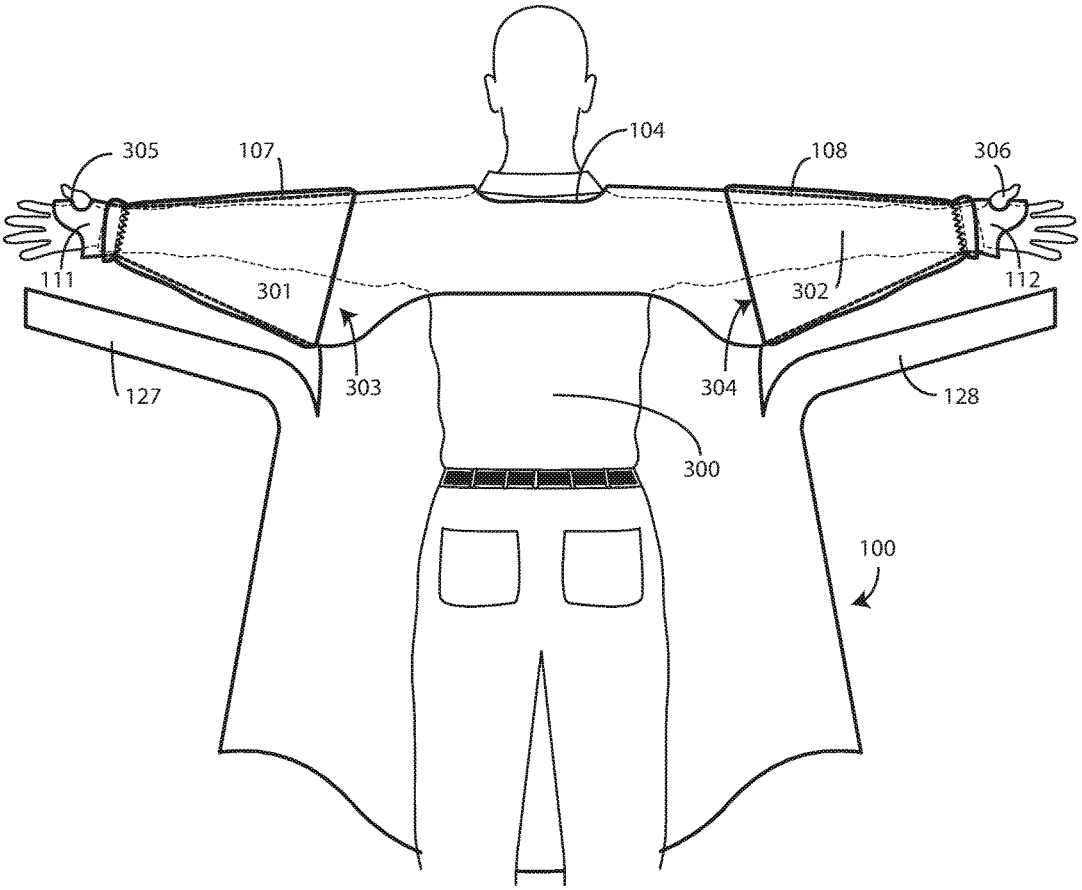
FIG. 3 illustrates a first step of a method of using a gown in accordance with one or more embodiments of the disclosure.
Figure 4:
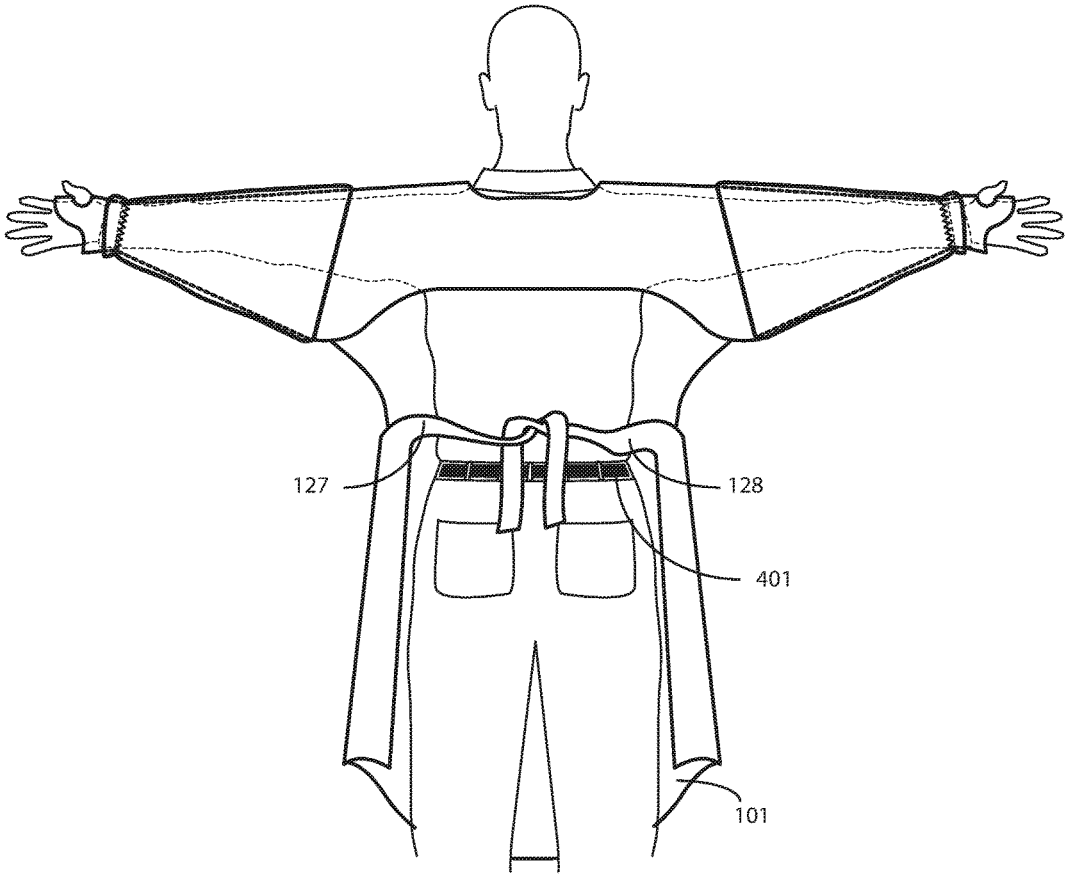
FIG. 4 illustrates a second step of a method of using a gown in accordance with one or more embodiments of the disclosure.

Turning now to FIGS. 3-8, illustrated therein are the various steps of donning a gown 100 in accordance with one or more embodiments of the disclosure. Beginning with FIG. 3, a wearer 300 can be seen donning the gown 100. Specifically, the wearer 300 has inserted his head into the head insertion aperture 104. Also, the wearer 300 has inserted his arms 301,302 into the arm insertion apertures 303,304 of each sleeve 107,108. The wearer 300 has inserted his thumbs 305,306 into the thumb loops 111,112, thereby latching the thumb loops 111,112 about the thumbs 305,306 to retain the sleeves 107,108 snugly along each arm 301,302. The ties 127,128 are initially untied as shown in FIG. 3. However, once tied, the ties 127,128 cinch the body covering portion 101 at the user's waist 401 as shown in FIG. 4.

Figure 5:
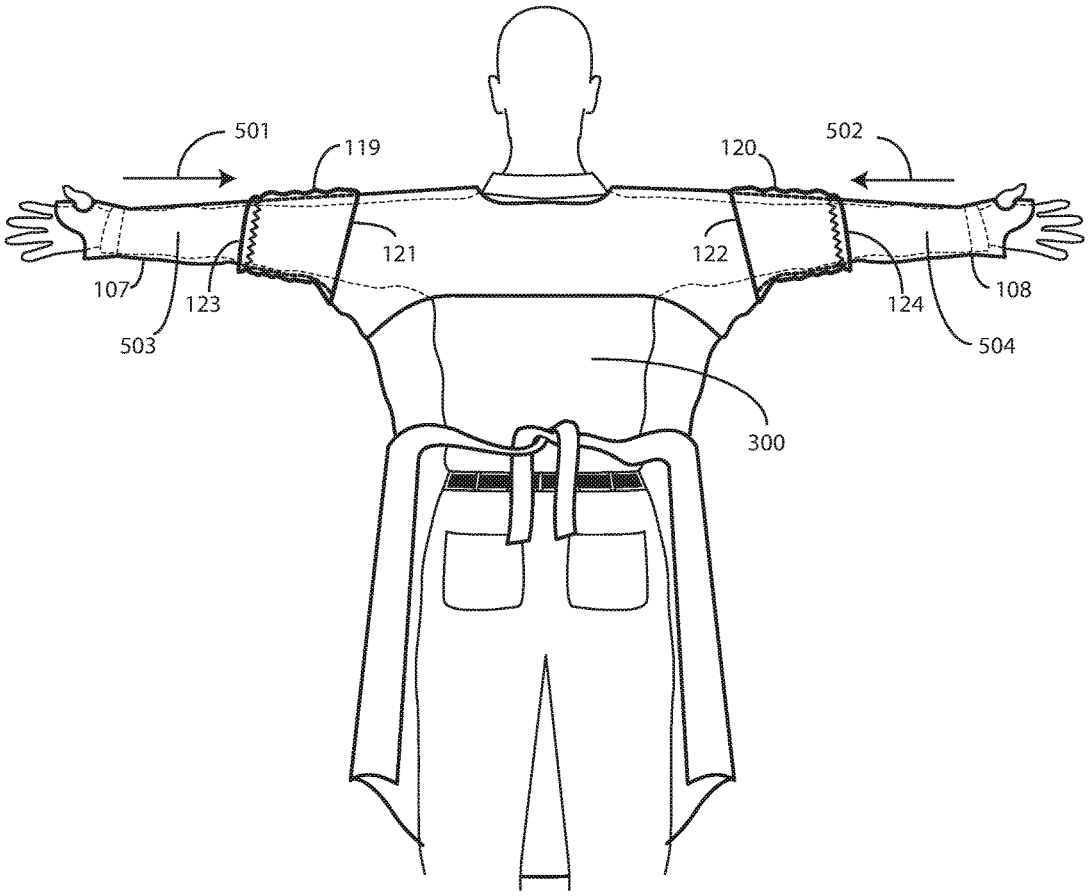
FIG. 5 illustrates a third step of a method of using a gown in accordance with one or more embodiments of the disclosure.

Turning now to FIG. 5, here the wearer 300 has translated 501,502 the first termination boundary 123 of the first concentric sleeve 119 and the second termination boundary 124 of the second concentric sleeve 120 toward the first connection location 121 and the second connection location 122, respectively. This translation 501,502 reveals additional portions 503,504 of the first sleeve 107 and the second sleeve 108, respectively, each of which was previously disposed beneath the first concentric sleeve 119 and the second concentric sleeve 120.

Figure 6:
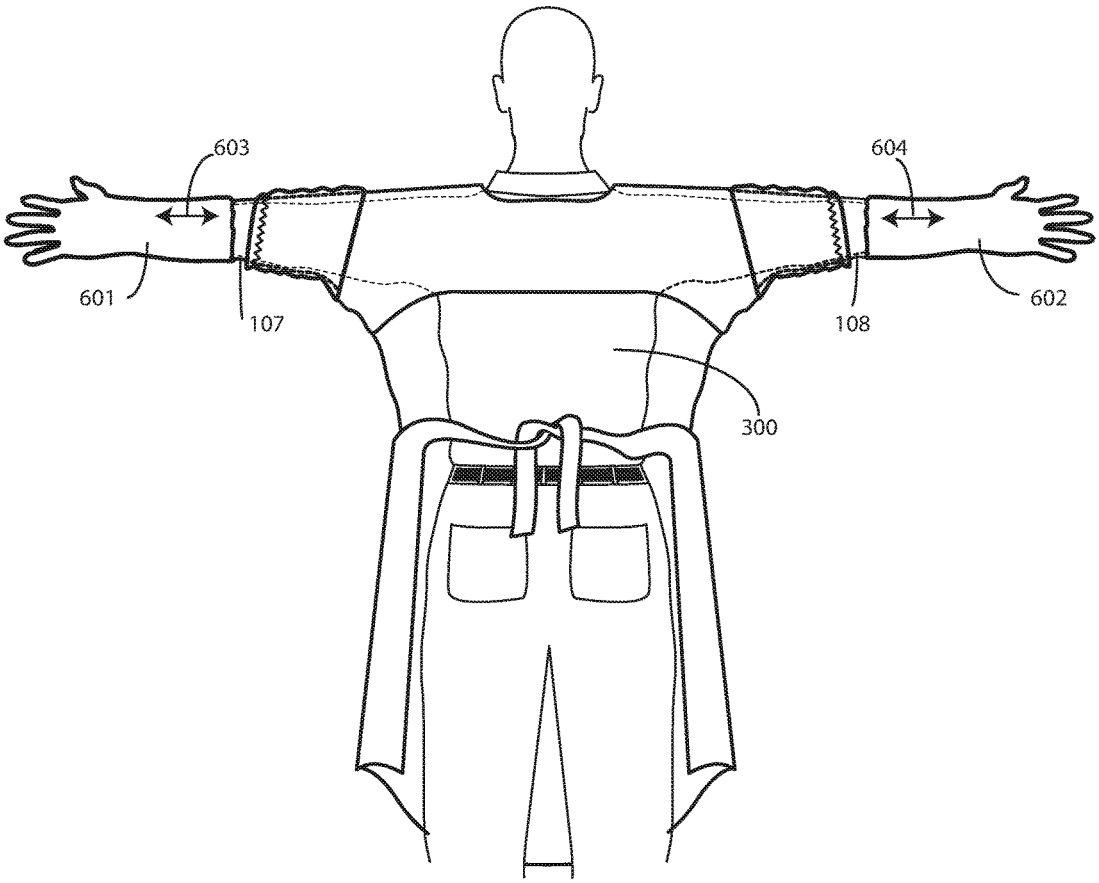
FIG. 6 illustrates a fourth step of a method of using a gown in accordance with one or more embodiments of the disclosure.

Turning now to FIG. 6, the wearer 300 dons a first glove 601 and a second glove 602. As shown in FIG. 6, at least a portion 603,604 of the first glove 601 and the second glove 602 extends along the exterior of the first additional portion (503) of the first sleeve 107 and the second additional portion (504) of the second sleeve 108.

Figure 7:
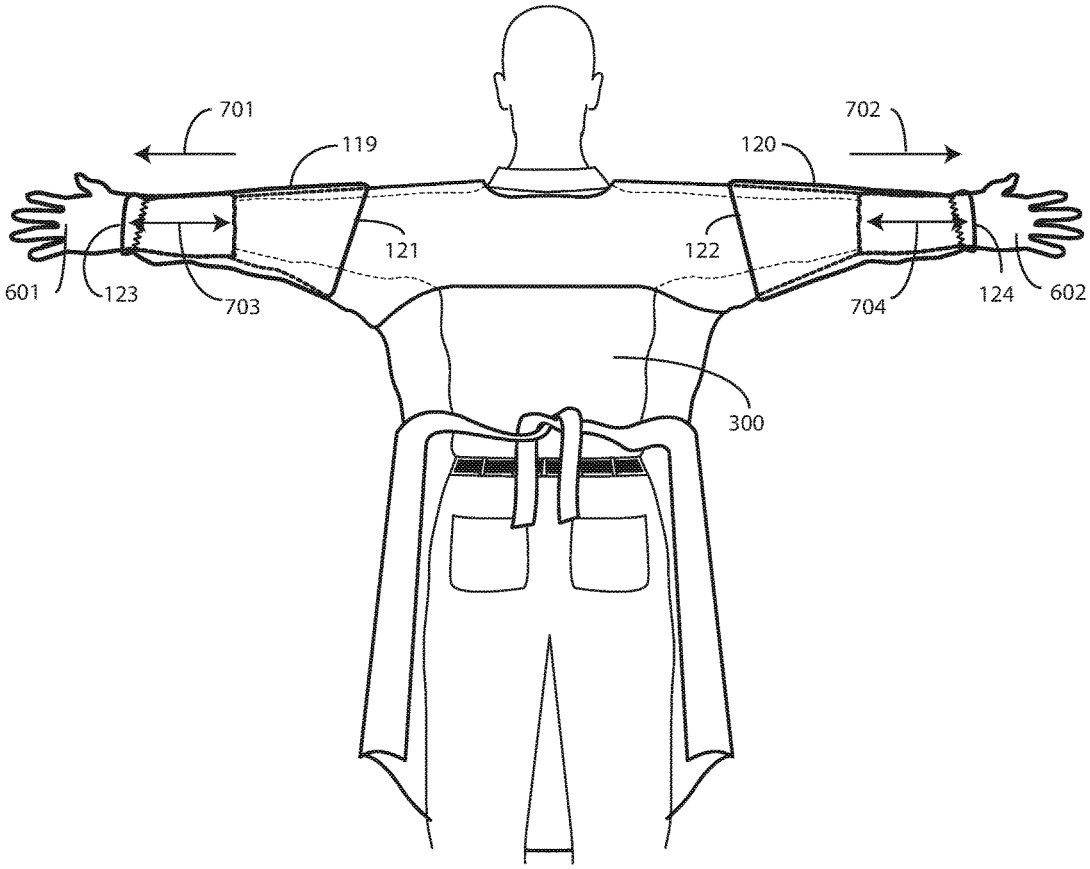
FIG. 7 illustrates a fifth step of a method of using a gown in accordance with one or more embodiments of the disclosure.

Turning now to FIG. 7, the wearer 300 then retranslates 701,702 the first termination boundary 123 of the first concentric sleeve 119 and the second termination boundary 124 of the second concentric sleeve 120 away from the first connection location 121 and the second connection location 122, respectively. Said differently, the wearer 300 then retranslates 701,702 the first termination boundary 123 of the first concentric sleeve 119 and the second termination boundary 124 of the second concentric sleeve 120 toward the first thumb loop (111) and the second thumb loop (112), respectively. As shown in FIG. 7, this retranslation 701,702 includes placing at least a portion 703 of the first concentric sleeve 119 exterior to the portion 603 of the first glove 601, and placing at least a portion 704 of the second concentric sleeve 120 exterior to the portion 604 of the second glove 602.

Figure 8:
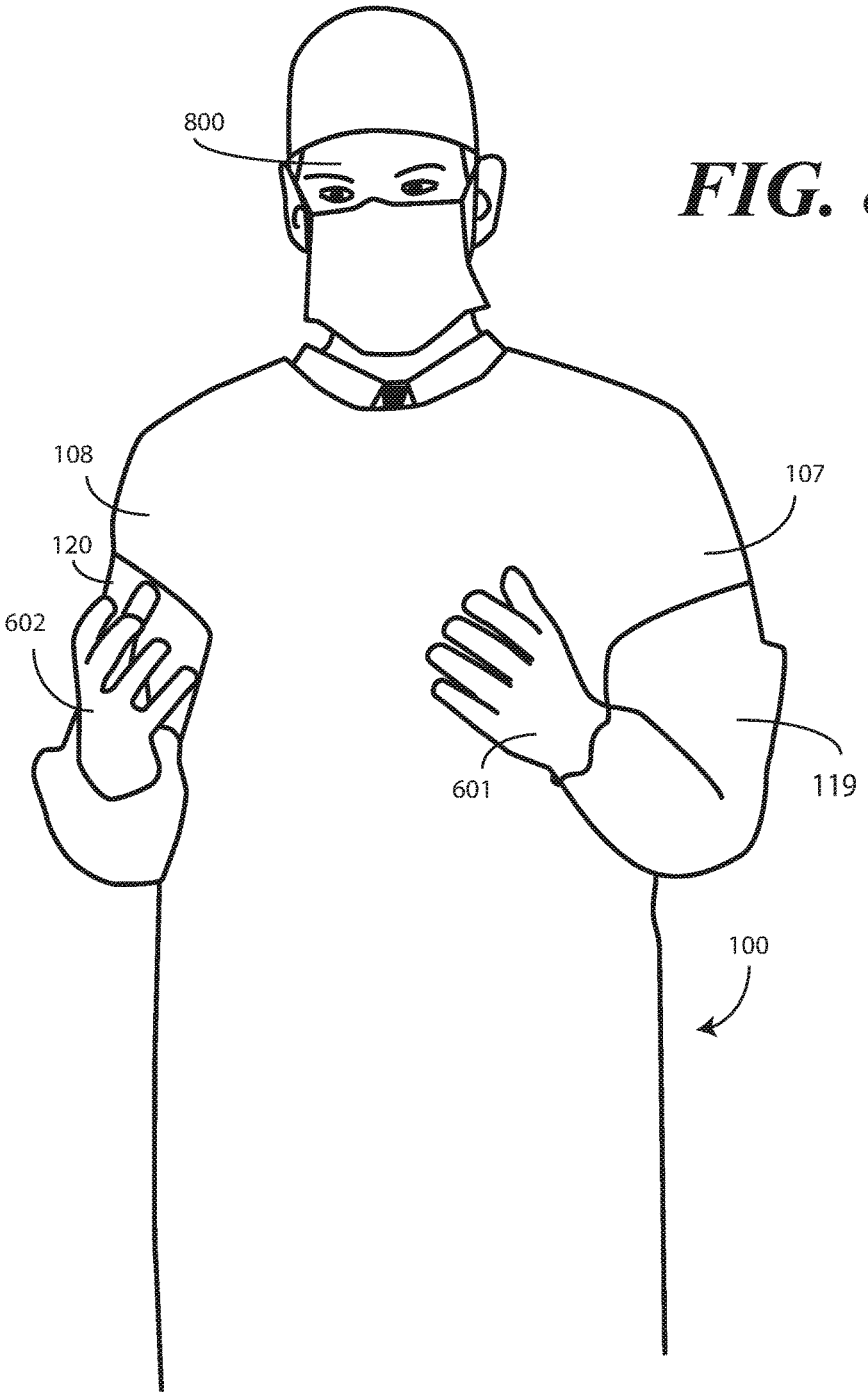
FIG. 8 illustrates a user wearing one explanatory gown in accordance with one or more embodiments of the disclosure.

Turning now to FIG. 8, a medical professional 800 is shown wearing one embodiment of a gown 100 configured in accordance with one or more embodiments of the disclosure. The first sleeve 107 and the second sleeve 108 are covered by the base of the first glove 601 and the base of the second glove 602. The first concentric sleeve 119 and the second concentric sleeve 120 then cover the base of the first glove 601 and the base of the second glove 602. Advantageously, this prevents the channeling of liquids into the gloves 601,602. Should additional protection be required, another pair of gloves can be placed atop the first glove 601 and the second glove 602, with the additional gloves covering portions of the first concentric sleeve 119 and the second concentric sleeve 120.

Advantageously, the configuration of FIG. 8 serves to protect the medical professional 800 from coming into contact with fluids, which may contain pathogens and microorganisms carrying communicable diseases. As medical professionals generally interact with such fluids with their hands and arms, rather than other parts of their bodies, the inclusion of sealed sleeves in a gown 100, as shown in FIG. 8, eliminates a large majority of pathways between the fluid and medical professional 800.

In one or more embodiments, the gown 100 is configured to meet the PB70 Standard of the Association for the Advancement of Medical Instrumentation (AAMI). For example, the gown 100 may have a moisture vapor transmission rate (MVTR) that allows for comfort during wearing while still meeting the Spray impact test (AATCC42), Hydrostatic Pressure testing (AATCC127) and Viral Penetration testing (ASTM-F1671) guidelines. For medical applications the gown 100 can have vapor and moisture barrier characteristics that may be required by an applicable AAMI level. In one embodiment, the gown 100 protects to an AAMI-PB70 Level-3 level or rating.

Figure 9:
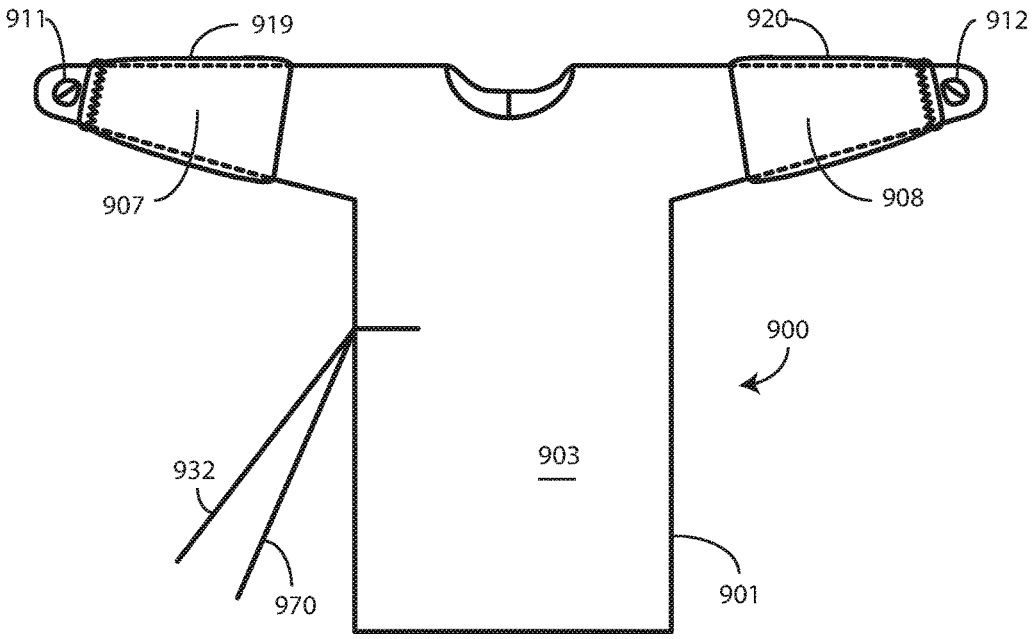
FIG. 9 illustrates a front elevation view of an alternate gown in accordance with one or more embodiments of the disclosure.
Figure 10:
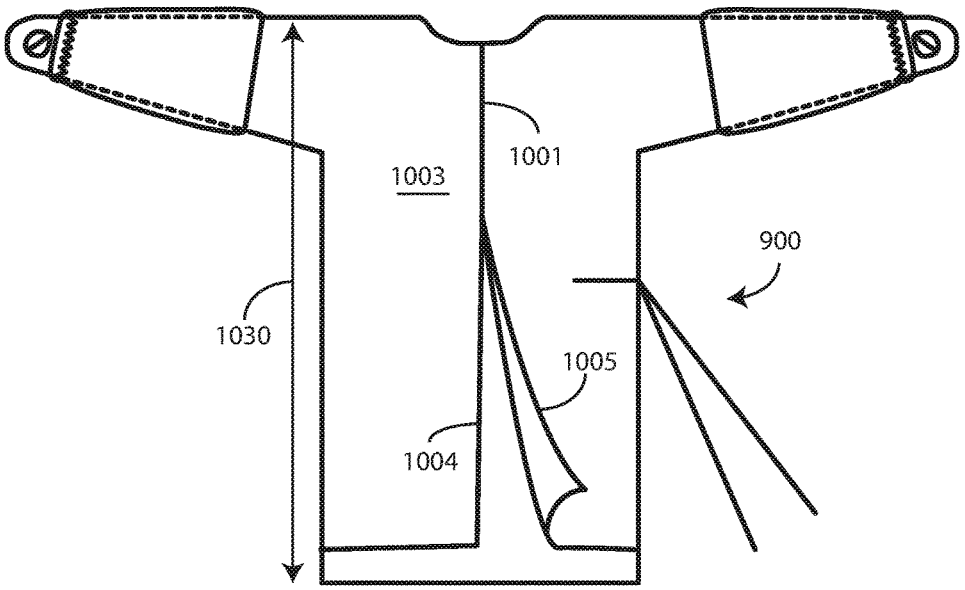
FIG. 10 illustrates a rear elevation view of an alternate gown in accordance with one or more embodiments of the disclosure.

Turning now to FIGS. 9 and 10, illustrated therein is an alternate gown 900 configured in accordance with embodiments of the disclosure. As before, a body covering portion 901 is configured to wrap about the torso of a wearer. The body covering portion 901 of FIG. 9 differs from the body covering portion (101) of FIG. 1 in that it is substantially rectangular when viewed from a plan perspective. Additionally, it fully covers the backside of a wearer, while the body covering portion (101) only partially covered the backside of a wearer. Other elements of the body covering portion 901 of FIG. 9 can be the same as that of FIG. 1. For example, the body covering portion 901 of FIG. 9 can be manufactured from a single, unitary layer of polyethylene or polyurethane.

The body covering portion 901 includes a front portion 903 and a rear portion 1003. The front portion 903 is configured as a frontal body covering portion in that it is configured to cover the frontal portion of some or all of a user's body, or in another embodiment the frontal portion of some or all of a user's torso, when the user is wearing the gown. The body covering portion 901 further includes a rear portion 1003 that is configured to cover substantially all of a wearer's backside. In the illustrative example of FIGS. 9 and 10, the rear portion 1003 has a shorter length than the front portion 903, although this is but one configuration for one embodiment. In another embodiment, shown in FIGS.

11 and 12, the front portion (1103) will be substantially the same length as the rear portion (1203), and so forth. In other embodiments, the front portion 903 may be shorter than the rear portion 1003, thereby covering less of the wearer's body in the front than in the rear.

In one embodiment, the body covering portion 901 defines an opening 1001. The front portion 903 of the gown 900 is configured, in one embodiment, to be placed against the front of the torso of a wearer. The body covering portion 901 then wraps around and terminates at the opening 1001. The opening 1001 in this embodiment has a left side 1004 and a right side 1005 that abut due to the fact that the opening 1001 is configured as a slit that runs the length 1030 of the rear side 1003 of the back of the gown 900. The opening 1001 can be used to assist in donning the gown as previously described.

In one embodiment, a first sleeve 907 and a second sleeve 908 extend distally from the body covering portion 901. The first sleeve 907 and the second sleeve 908 are configured to receive wearer's arms when the gown 900 is donned. As with previous embodiments, the gown 900 has sleeves 907,908 that each terminate in a thumb loop 911,912.

As with previous embodiments, a first concentric sleeve 919 and a second concentric sleeve 920 are coupled to the first sleeve 907 and the second sleeve 908, respectively. The first concentric sleeve 919 and the second concentric sleeve 920 extend along an exterior of the first sleeve 907 and second sleeve 908, respectively, toward the thumb loops 911,912. The first concentric sleeve 919 and the second concentric sleeve 920 function in the same manner as previously described.

In one embodiment, the gown 900 includes one or more ties 932 that can be tied together to close the opening 1001. For example, one tie 932 can be provided shown on one of the gown 900 that wraps completely around the wearer. In another embodiment, a second tie 970 can attach to the gown 900 at a common connection point with the first tie 932. When a wearer dons the gown 900, they can wrap the first tie 932 around the front of their torso and the second tie 970 around the back, tying the first tie 932 and the second tie 970 together on the left side of their torso. In yet another embodiment, as shown in FIG. 12, a second tie 1270 can be attached as a mirror image of tie 1232 on the left side of the gown 1200 as well.

The tie members 1232,1270 can be attached to the gown 1200 in a variety of ways. In one embodiment, the tie members 1232,1270 are sewn to the gown 1200. In another embodiment, the tie members 1232,1270 are adhesively attached to the gown 1200. In another embodiment, the tie members 1232,1270 are thermally bonded to the gown 1200. Other attachment methods will be obvious to those of ordinary skill in the art. These attachment methods could be used for the ties (932,970) of FIGS. 9-10 as well. In the illustrative embodiments of FIGS. 9-12, the tie members are attached at hip regions of the gowns. When the tie members are tied across the opening, the body covering portion become "cinched" at the waist region about the wearer.

Figure 11:
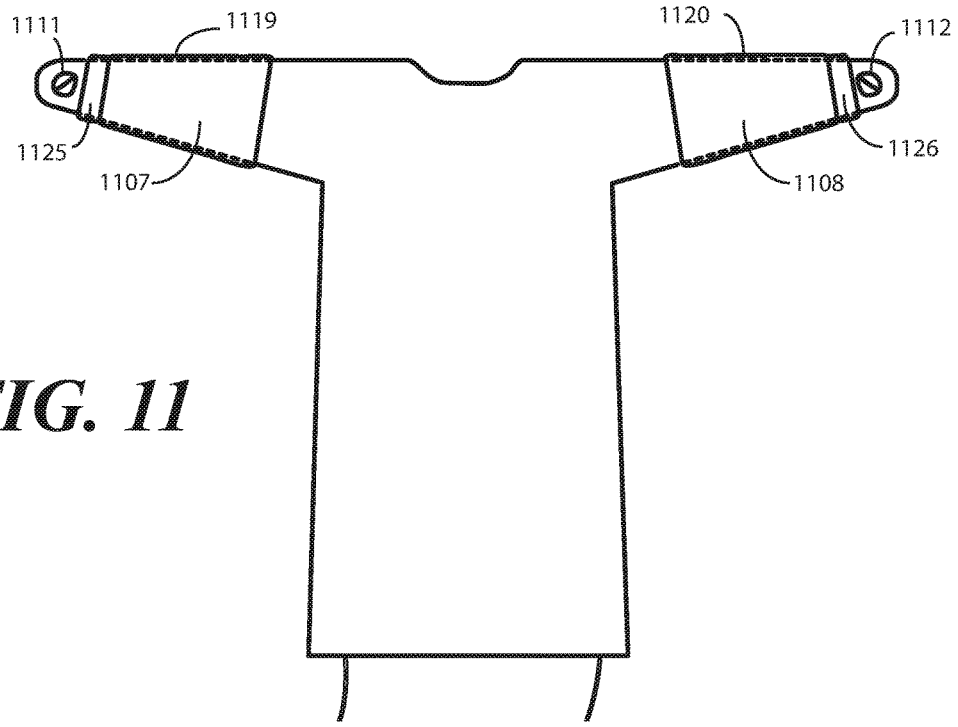
FIG. 11 illustrates a front elevation view of yet another gown in accordance with one or more embodiments of the disclosure.
Figure 12:
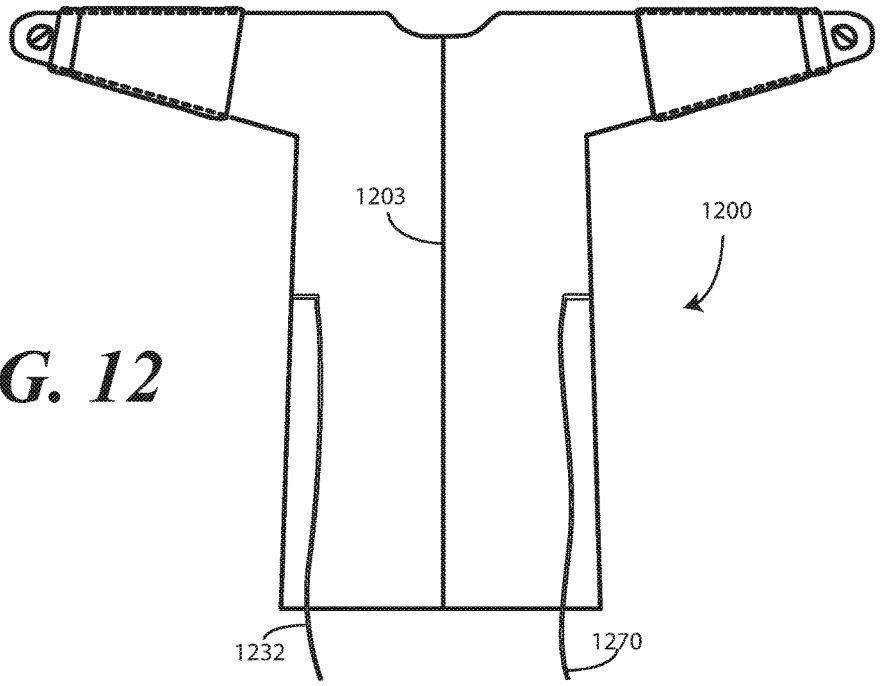
FIG. 12 illustrates a rear elevation view of yet another gown in accordance with one or more embodiments of the disclosure.

In the embodiment of FIGS. 11-12, the gown 1200 includes a first sleeve 1107 and a second sleeve 1108, each of which extends distally from the body covering portion 1101. The first sleeve 1107 and the second sleeve 1108 are configured to receive wearer's arms when the medical gown 1100 is donned. As with previous embodiments, the medical gown 1100 has sleeves 1107,1108 that each terminate in a thumb loop 1111,1112.

As with previous embodiments, a first concentric sleeve 1119 and a second concentric sleeve 1120 are coupled to the first sleeve 1107 and the second sleeve 1108, respectively. The first concentric sleeve 1119 and the second concentric sleeve 1120 extend along an exterior of the first sleeve 1107 and second sleeve 1108, respectively, toward the thumb loops 1111,1112.

In this illustrative embodiment, the first concentric sleeve 1119 and the second concentric sleeve 1120 function generally in the same manner as previously described. However, instead of including an elastic gathering (125,126), in this illustrative embodiment the first concentric sleeve 1110 and the second concentric sleeve 1120 terminate at a knitted cuff 1125,1126. The knitted cuffs 1125,1126 define the termination boundaries of each of the first concentric sleeve 1119 and the second concentric sleeve 1120 in this embodiment.

Figure 13:
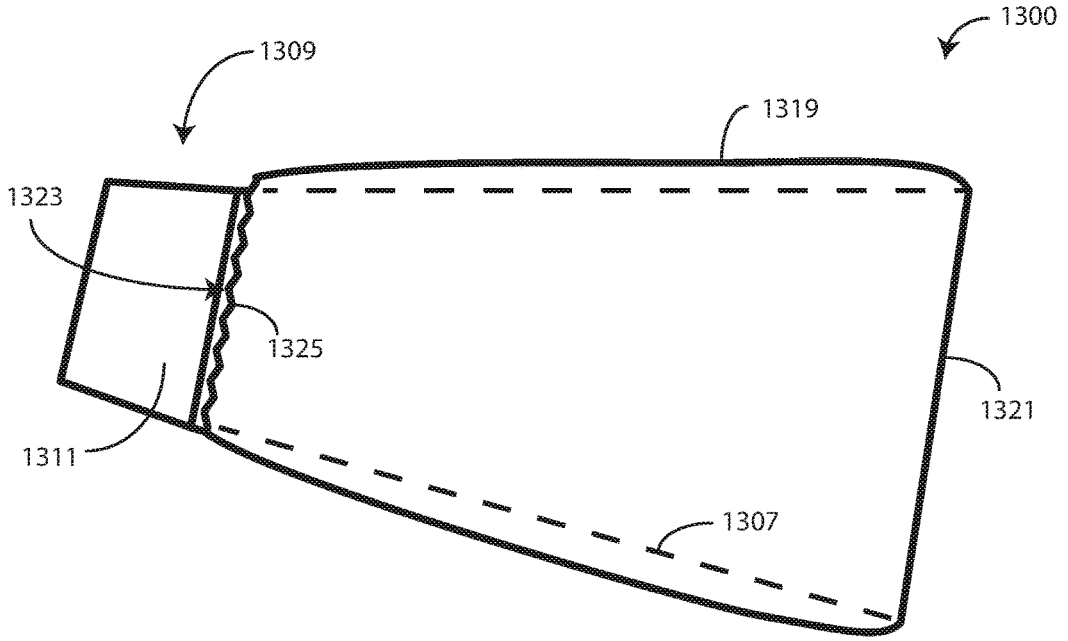
FIG. 13 illustrates an alternate sleeve in accordance with one or more embodiments of the disclosure.

Turning now to FIG. 13, illustrated therein is yet another sleeve assembly 1300 configured in accordance with one or more embodiments of the disclosure. The sleeve assembly 1300 can be used as the right sleeve, left sleeve, or combinations thereof for a medical gown in accordance with one or more embodiments of the disclosure.

The sleeve assembly 1300 of FIG. 13 includes an inner sleeve 1307 and a concentric outer sleeve 1319. The concentric outer sleeve 1319 is coupled to the inner sleeve 1307 at a connection location 1321. As before, the concentric outer sleeve 1319 extends from the connection location 1321 along an exterior of the inner sleeve 1307 toward a retention device 1309. In this illustrative embodiment, the retention device 1309 is a knitted cuff 1311 rather than a thumb loop. Another difference occurring in the embodiment of FIG. 13 is that the elastic gathering 1325 of the concentric outer sleeve 1319 is disposed at the termination boundary 1323 of the concentric outer sleeve 1319. Otherwise, the sleeve assembly 1300 can be used in the same manner as described above with reference to FIGS. 3-8.

Figure 14:
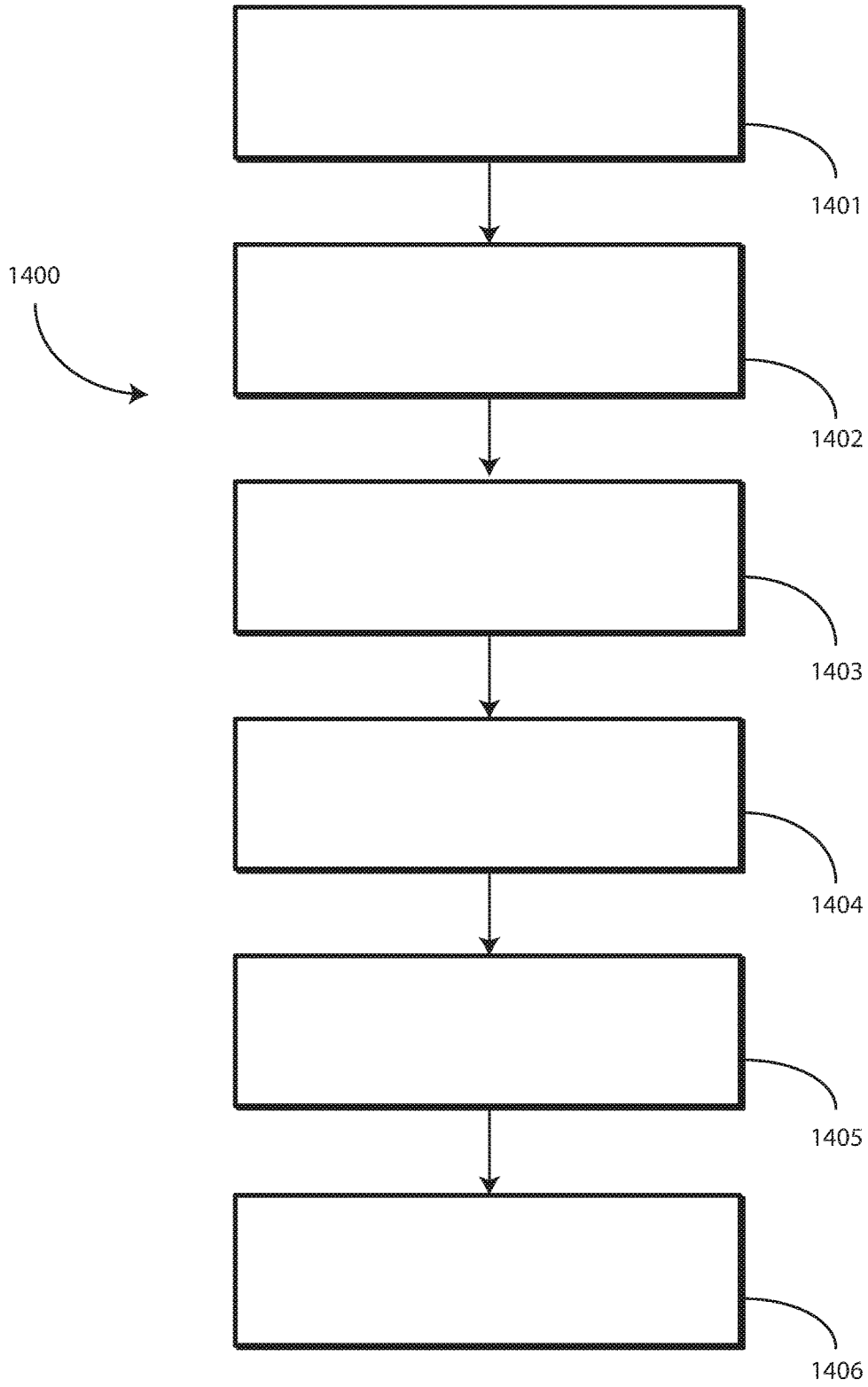
FIG. 14 illustrates one explanatory method of manufacturing a gown in accordance with one or more embodiments of the disclosure.

Turning now to FIG. 14, illustrated therein is a method 1400 of manufacturing a gown in accordance with one or more embodiments of the disclosure. At step 1401, the method 1400 includes causing a first sleeve and a second sleeve to extend from a body covering to a retention device. In one embodiment, the retention device occurring at step 1401 comprises a thumb loop. In another embodiment, the retention device occurring at step 1401 comprises a knitted cuff. Other retention devices will be obvious to those of ordinary skill in the art having the benefit of this disclosure.

At step 1402, the method 1400 includes attaching a first concentric sleeve to the first sleeve at a first connection location such that the first concentric sleeve extends along an exterior of the first sleeve toward the thumb loop. At step 1403, the method 1400 includes attaching a second concentric sleeve to the second sleeve at a second connection location such that the second concentric sleeve extends along the exterior of the second sleeve toward the thumb loop.

In one or more embodiments, optional step 1404 includes causing the first sleeve to extend beyond a first termination boundary of the first concentric sleeve such that the thumb loop of the first sleeve extends beyond the first termination boundary. Similarly, optional step 1405 can include causing the second sleeve to extend beyond a second termination boundary of the second concentric sleeve such that the thumb loop of the second sleeve extends beyond the second termination boundary. At optional step 1406, the method 1400 can include attaching one or more ties to the body covering portion of the gown.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A gown, comprising:

a body covering portion;

a first sleeve and a second sleeve, each extending distally away from the body covering portion and terminating at a thumb loop;

a first concentric sleeve coupled to the first sleeve at a first connection location disposed at a shoulder of the first sleeve and extending along an exterior of the first sleeve toward the thumb loop to a first termination boundary landing at a wrist location of the first sleeve, the first termination boundary selectively slidable along the first sleeve toward the first connection location; and a second concentric sleeve coupled to the second sleeve at a second connection location disposed at a shoulder of the second sleeve and extending along the exterior of the second sleeve toward the thumb loop to a second termination boundary landing at a wrist location of the second sleeve, the second termination boundary selectively slidable along the second sleeve toward the second connection location.

2. The gown of claim 1, the first termination boundary disposed between the thumb loop and the first connection location.

3. The gown of claim 2, the second termination boundary disposed between the thumb loop and the second connection location.

4. The gown of claim 3, the first concentric sleeve comprising an elastic gathering drawing the first concentric sleeve toward the first sleeve, the elastic gathering disposed between the first connection location and the first termination boundary.

5. The gown of claim 4, the elastic gathering disposed closer to the first termination boundary than the first connection location.

6. The gown of claim 5, the elastic gathering disposed at the first termination boundary.

7. The gown of claim 4, the second concentric sleeve comprising another elastic gathering drawing the second concentric sleeve toward the second sleeve, the another elastic gathering disposed between the second connection location and the second termination boundary.

8. The gown of claim 3, the first concentric sleeve comprising a cuff defining the first termination boundary, the second concentric sleeve comprising another cuff defining the second termination boundary.

9. The gown of claim 1, the first sleeve and the first concentric sleeve manufactured from the same material.

10. The gown of claim 1, the first concentric sleeve manufactured from different materials.

11. The gown of claim 1, wherein the body covering portion, the first sleeve, and the second sleeve are manufactured from polyethylene.

12. The gown of claim 1, the body covering portion comprising a front portion and a rear portion, wherein the front portion is longer than the rear portion.

13. The gown of claim 12, the front portion configured to cover a frontal portion of a wearer, the rear portion configured to cover only shoulders of the wearer.

14. The gown of claim 1, wherein the body covering portion, the first sleeve, and the second sleeve comprise a single, unitary, contiguous piece of liquid impervious material.

15. The gown of claim 1, wherein the gown is configured to meet the PB70 Standard of the Association for the Advancement of Medical Instrumentation (AAMI).

16. The gown of claim 1, the body covering portion defining an opening comprising a slit having a left side and a right side that abut.

17. The gown of claim 16, the slit running the length a rear side of a back of the gown.

* * * * *